US007307546B1

(12) United States Patent
Partap

(10) Patent No.: US 7,307,546 B1
(45) Date of Patent: Dec. 11, 2007

(54) BIMODAL REPLACEMENT TRAFFIC LIGHT

(76) Inventor: Trevor Partap, 121 Vine St., #1007, Seattle, WA (US) 98121

( * ) Notice: Subject to any disclaimer, the term of this patent is extended or adjusted under 35 U.S.C. 154(b) by 226 days.

(21) Appl. No.: 11/113,721

(22) Filed: Apr. 26, 2005

(51) Int. Cl.
*G08G 1/095* (2006.01)
*G08B 5/22* (2006.01)

(52) U.S. Cl. ..... 340/907; 340/908; 340/908.1; 340/815.45; 362/800; 362/612

(58) Field of Classification Search ..... 340/907, 340/815.45, 908, 908.1, 407
See application file for complete search history.

(56) References Cited

U.S. PATENT DOCUMENTS 3,983,532 A 9/1976 Hayes
5,036,248 A * 7/1991 McEwan et al. ..... 313/500
5,528,474 A * 6/1996 Roney et al. ..... 362/545
5,663,719 A * 9/1997 Deese et al. ..... 340/912
6,054,932 A 4/2000 Gartner et al.
6,072,407 A 6/2000 Shin
6,380,865 B1 * 4/2002 Pederson ..... 340/815.45
6,383,613 B1 * 5/2002 Takeda ..... 428/195.1
6,762,689 B2 * 7/2004 Dechape ..... 340/815.45
6,905,227 B2 * 6/2005 Wu ..... 362/240

* cited by examiner

*Primary Examiner*—Donnie L. Crosland
(74) *Attorney, Agent, or Firm*—Crossley Patent Law; Mark A. Crossley

(57) ABSTRACT

A bimodal traffic replacement light for fitting within an existing housing of a traffic signal, the replacement light fitted with light emitting diodes, the replacement light providing for lighting the diodes in the full diode field or selectively lighting a number of diodes in the field to form a shape of a directional signal. The replacement traffic light is offered in examples with or without lenses. The invention is exemplified by clear light emitting diodes within green, red, and yellow lenses, or further, by green, yellow, and red light emitting diodes within clear lenses.

18 Claims, 3 Drawing Sheets

BIMODAL REPLACEMENT TRAFFIC LIGHT

FIELD OF THE INVENTION

The invention relates to traffic signaling apparatus and in particularly to a bimodal traffic replacement light for replacing existing lights within a traffic signal.

BACKGROUND OF THE INVENTION

A need exists for improvements in current traffic signal lighting. Lighting should be brighter than many currently used incandescent lights. Lighting should also be more selective in that fields of light within a given lens are capable of displaying directional signals. Existing traffic signal controllers could thereby utilize directional signals at various times of day, when further traffic control is desired. Such improvements will allow a traffic signal of four lights in a vertical row to be reduced to three, thereby saving time and expense with traffic signal installations and maintenance.

Where a currently existing traffic signal has a red, a yellow, a green, and an arrow lens and accompanying housing for each, improvements are needed in order to eliminate the separate arrow lens and housing. Further, removal of the additional lens and housing reduces the vertical height of traffic signals. Height reduction of the signal is especially desirable in installations where vertical clearance is a concern. Traffic signal lighting improvements should be applicable to existing traffic signals so that improvements do not require replacement of an entire signal. Improvements should also negate the need to replace given housing within the signals. Signals are expensive; therefore the improvements must be cost effective. Utilization of all possible existing equipment is therefore ideal.

SUMMARY OF THE INVENTION

In view of the foregoing considerations and others now present in the art of signaling traffic, a bimodal traffic replacement light is needed. As such, the general purpose of the bimodal traffic replacement light, described subsequently in greater detail, is to provide a replacement light which has many novel features that result in an improved traffic signal which is not anticipated, rendered obvious, suggested, or even implied by prior art, either alone or in combination thereof.

To accomplish this, the bimodal replacement traffic light removably fits into an existing exterior panel of a single or multiple light housing of a typical traffic signal. Light housings are typical in the art of traffic signals. The replacement light comprises a round lens case. The lens case has a front and a back. The front of lens case is further comprised of a flange about the outer perimeter of the lens case. The flange is typically held to exterior panel via attachment ears. Attachment ears secure the flange to the exterior panel. Attachment ears are held to the exterior case via typical fasteners. The back of the lens case further comprises a cylindrical projection. Yet other examples feature varied shapes and sizes in place of the cylindrical projection. These examples provide for fitting varied shapes and sizes of traffic signals. The cylindrical projection is of a diameter less than the lens case. The cylindrical projection further comprises a wire outlet. Wires exit the wire outlet. Wires are connected to an existing wire terminal within the light housing. The field of light emitting diodes within the front of the lens case is positioned to project light from the front of the case. The light emitting diodes are, to accommodate various applications, selected from a group of colored light emitting diodes. The group of colored light emitting diodes consists of the colors clear, red, yellow, and green. Light emitting diodes are known in the art as LED's. The diode field comprises the area of light emitting diodes. In the most basic example of the invention, a first set of wires connects to a first set of the light emitting diodes. The first set of light emitting diodes forms the shape of a traffic regulating indicating arrow. A second set of wires connects to a second set of light emitting diodes.

The second set of light emitting diodes comprises all of the light emitting diodes in the field. A common circuit connects all of the light emitting diodes. A lead common wire is connected to the common circuit. A first lead wire is connected to the first set of wires. A second lead wire is connected to the second set of wires. A wire outlet in the back of the lens case provides for exit of the common wire, the first lead wire, and the second lead wire from the lens case. The wires connect to a wire terminal of the traffic signal. The common wire, the first lead wire, and the second lead wire are selectively powered by a controller of the traffic signal. The diodes are therefore capable of being lit and unlit within the entire diode field by the second lead wire. The invention is further capable of selectively powering the first lead wire to light the diodes to create a traffic regulating directional signal. The exemplary shape is not limited to but includes a directional arrow, of chosen direction. Diodes around a chosen area are selectively unlit.

In a more complete example, the invention comprises additional lighting capabilities. A set of wires is connected to a set of light emitting diodes such that the lighting of the set forms a left traffic regulating arrow. An additional set of wires is connected to diodes such that the lighting of the set forms a right arrow. Another set of wires is connected to the diodes such that the lighting of the set forms a straight arrow. A final set of diodes includes the entire diode field, such that lighting of the diodes lights the entire field. Each set of wires has a lead wire exiting the lens case. The lead wires connect to the terminal within the traffic signal.

All diodes are connected to the common in order to complete the circuit utilized. In further examples, sets of wires are replaced by a printed circuit or even a circuit board, or the like.

A lens is affixed to the front of lens case. Examples of the invention are provided both with and without lenses. The lens extends through the exterior panel to be visibly displayed outside of the traffic signal. The lens covers light emitting diodes of the lens case.

A typical installation of the invention features three colored lenses. Each lens is installed in a traffic signal above the other. Typically, a red lens mode of the invention is installed in the uppermost position. The center positioned installation of the invention is comprised of a yellow lens. The lower installation of the invention comprises a green lens. Lenses offered are from a list of colored lenses comprising clear, red, green and yellow lenses.

In typical use, the invention is installed within traffic signals throughout an intersection, on all four sides. As example, in an intersection of two lane traffic each direction, the invention is installed in two lights facing oncoming traffic in each of the four possible directions. A traffic signal is typically overhead for the lane next to the center divider. Another traffic signal is over or next to the right lane. This traffic signal arrangement is duplicated for traffic in the opposite direction. Picturing this arrangement for northbound and southbound traffic, the same arrangement is provided for eastbound and westbound traffic. In a green light situation at a time of day of little traffic, both signals are fully green for northbound. Both signals are fully green for southbound.

Full green signals allow straight ahead driving, left turns, and right turns. Both eastbound and westbound traffic are faced with red signals. These signals alternate in typical fashion in reversing the given reds and greens.

At a time of day of increased traffic, each lane next to the center divider is provided with a straight ahead directional arrow. This arrow indicates that no left turn is allowed. The right lane of each direction is typically provided with full green in such situations, allowing the right lane to either progress straight ahead or turn right. Negating a left turn at a given time of day increases traffic safety and flow. Further, signage is typically provided to reinforce this message. Signage prohibiting a left turn between 4 and 6 PM, as example, is typical in the art. Existing traffic signal controllers that currently accommodate a typical four lens housing arrangements can easily signal the three lens arrangement of the present invention.

The current invention provides light emitting diodes for increasing the brightness of existing signals. The current invention also offers selective lighting of diodes within a diode field of each lens. The fields of light within a given lens are capable of displaying directional signals. Existing traffic signal controllers can thereby utilize directional signals at various times of day, when such further traffic control is desired. The present invention thereby provides a traffic signal of four lights in a vertical row to be reduced to three, thereby saving time and expense with traffic signal installations and maintenance.

Where a currently existing traffic signal has a red, a yellow, a green, and an arrow lens and accompanying housing for each, the current invention eliminates the separate arrow lens and housing. Further, removal of the additional lens and housing reduces the vertical height of traffic signals. Height reduction of the signal is especially desirable in installations where clearance is a concern. Traffic signal lighting improvements are thereby applicable to existing traffic signals so that improvements do not require replacement of an entire signal. Improvements offered by the present invention also negate the need to replace housings within the signals. Utilization of existing equipment is therefore provided by the present invention. The cost savings is quite significant.

Thus has been broadly outlined the more important features of the bimodal traffic replacement light so that the detailed description thereof that follows may be better understood and in order that the present contribution to the art may be better appreciated.

Numerous objects, features and advantages of the bimodal traffic replacement light will be readily apparent to those of ordinary skill in the art upon reading the following detailed description of presently preferred, but nonetheless illustrative, embodiments of the bimodal traffic replacement light when taken in conjunction with the accompanying drawings. In this respect, before explaining the current embodiments of the invention in detail, it is to be understood that the invention is not limited in its application to the details of construction and arrangements of the components set forth in the following description or illustration.

The invention is capable of other embodiments and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the bimodal traffic replacement light. It is therefore important that the claims be regarded as including such equivalent constructions insofar as they do not depart from the spirit and scope of the present invention.

Objects of the bimodal traffic replacement light, along with various novel features that characterize the invention are particularly pointed out in the claims forming a part of this disclosure. For better understanding of the bimodal traffic replacement light, its operating advantages and specific objects attained by its uses, refer to the accompanying drawings and description.

DETAILED DESCRIPTION OF THE DRAWINGS

With reference now to the drawings, and in particular FIGS. 1 through 5 thereof, the bimodal traffic replacement light employing the principles and concepts of the present invention and generally designated by the reference number 10 will be described.

Figure 3:
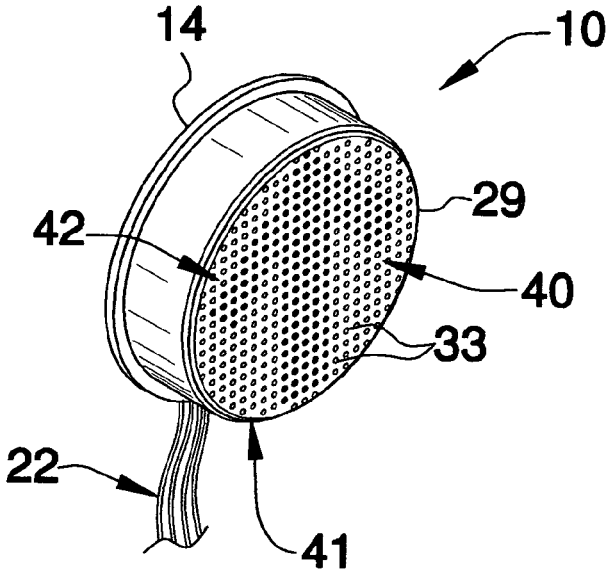
FIG. 3 is a perspective view of the invention showing a lit directional arrow in the diode field.
Figure 4:
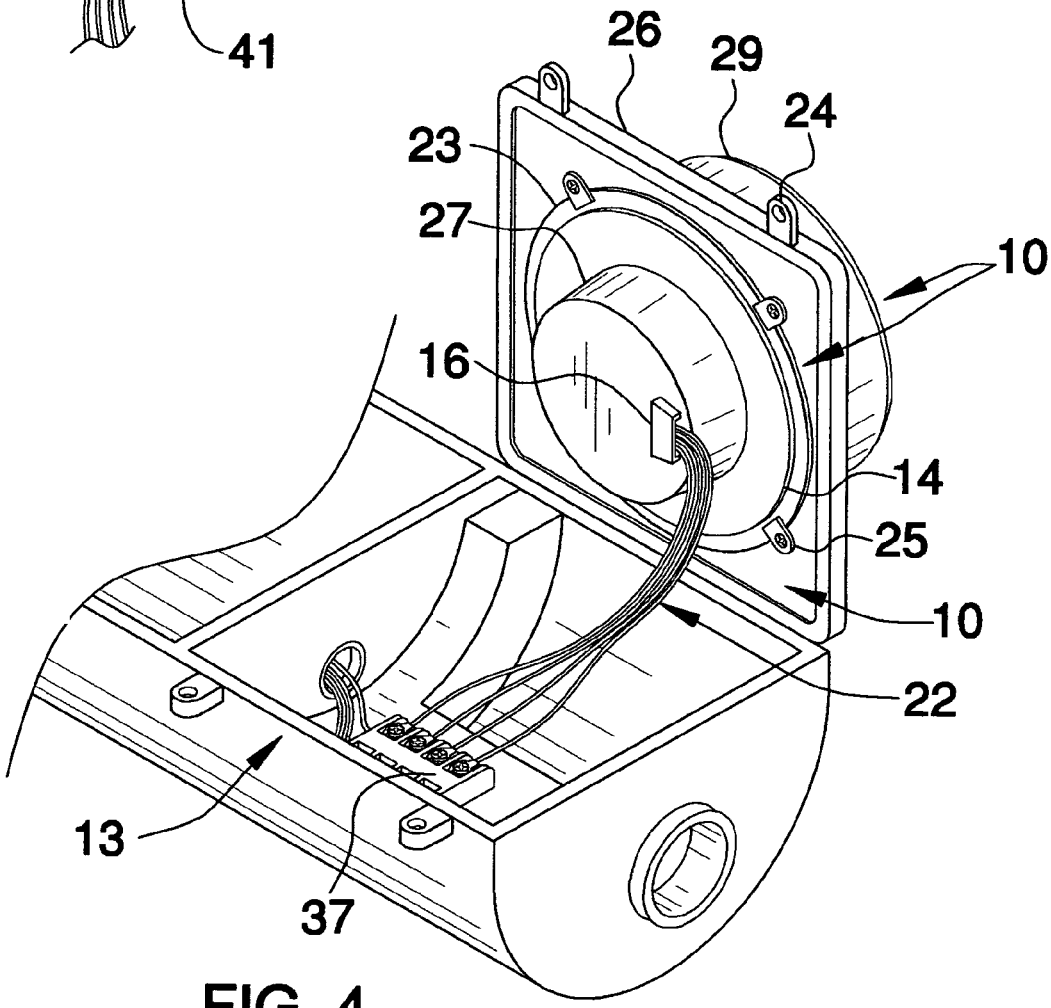
FIG. 4 is perspective view of the invention installed in the exterior panel of a single light housing of a typical traffic signal.

Referring to FIGS. 3 and 4, the bimodal replacement traffic light 10 removably fits into a typically existing exterior panel 26 of a single light housing 13. Single light housing 13 is typical in the art of traffic signals 12.

The replacement light 10 comprises a round lens case 14. Lens case 14 has a front and a back. The front of lens case 14 is further comprised of a flange 23 about the outer perimeter of lens case 14.

The flange 23 is typically held to exterior panel 26 via attachment ears 24. Attachment ears 24 overlap and secure flange 23 to exterior panel 26. Attachment ears 24 are held to exterior case 26 via typical fasteners. The back of the lens case 14 further comprises a cylindrical projection 27. The cylindrical projection 27 is of a diameter less than the lens case 14. The cylindrical projection 27 further comprises a wire outlet 16. Wires 22 exit wire outlet 16. Wires 22 are connected to the wire terminal 37 within the single light housing 13. Wires 22 are thereby powered by the typical existing powering means (not shown) of the traffic signal 12. Lens 29 is affixed to the front of lens case 14. Lens 29 extends through exterior panel 26 to be visibly displayed outside of traffic signal 12. Lens 29 covers light emitting diodes 33 within lens 29. Light emitting diodes 33 are mounted to the front of lens case 14. Diode field 41 comprises the area of light emitting diodes. Unlit diodes 42 substantially surrounds lit directional arrow 40. Unlit diodes 42 display a region of unlit light emitting diodes 33. Directional arrow 40 displays lit light emitting diodes 33. Directional arrow 40 is exemplary of what is selectively displayed within lens 29. Directional arrow 40 selectively points upwardly in FIG. 3. In further examples (not shown) directional arrow 40 points as chosen.

Figure 1:
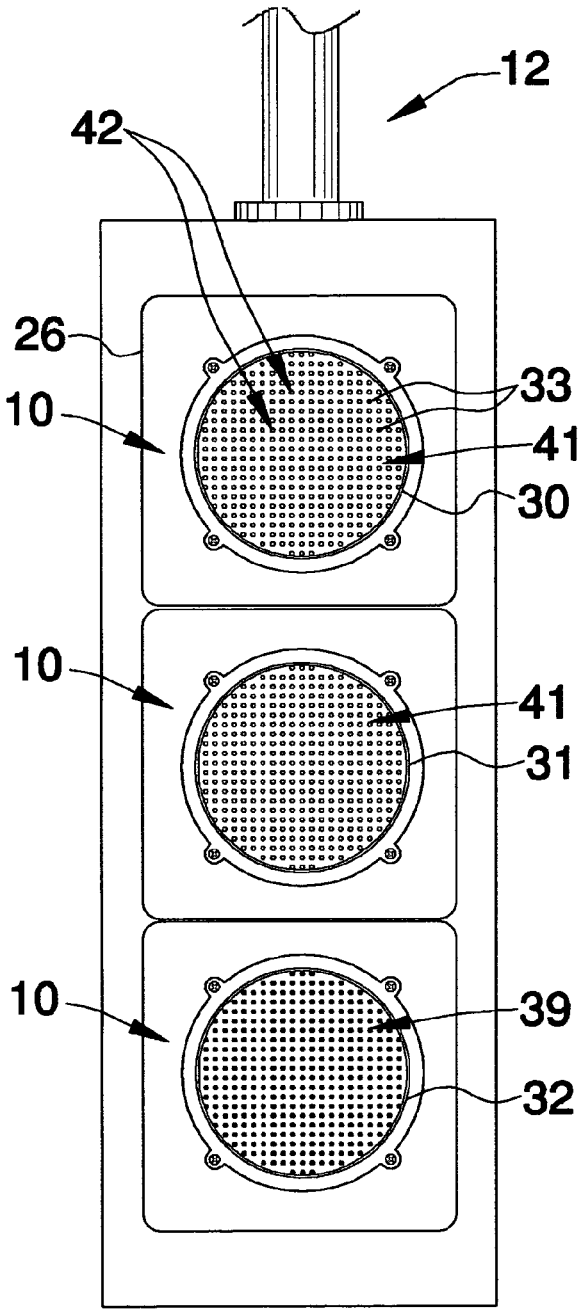
FIG. 1 is a frontal view of a traffic signal with the invention installed, with unlit red and yellow lenses and a fully lighted green lens.

Referring to FIG. 1, the invention 10 is mounted within traffic signal 12. The uppermost installation of invention 10 illustrates unlit area 42 within the entire diode field 41. The uppermost installation of invention 10 further comprises red lens 30. Diode field 41 is comprised of diodes 33. The center installation of invention 10 into traffic signal 12 is comprised of yellow lens 31. Yellow lens 31 covers diode field 41. The lower installation of invention 10 comprises green lens 32. Green lens 32 covers lighted diodes 39 in diode field 41. Lower installation of invention 10 within traffic signal 12 thereby indicates full red only signal to motorists (not shown) and others (not shown) in observance of signal 12.

Figure 2:
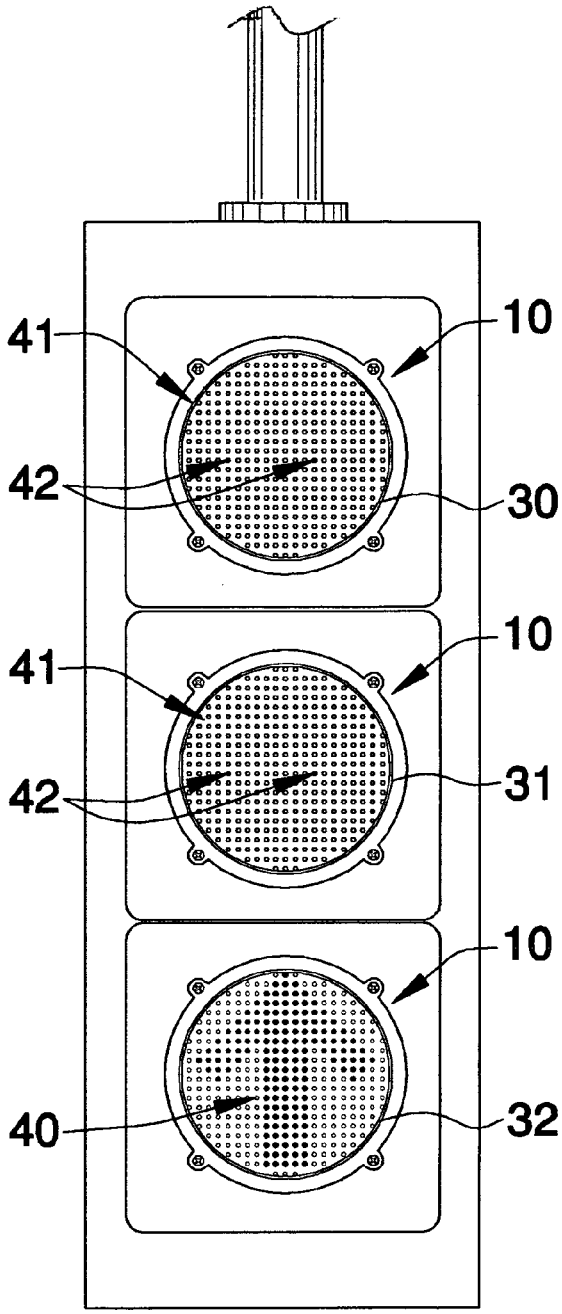
FIG. 2 is a frontal view of a traffic signal with a directional arrow lit within the green lens, the red and yellow lenses in an unlighted state.

Referring to FIG. 2, the installations of invention 10 are comprised of, from top to bottom, red lens 30, yellow lens 31, and green lens 32. Red lens 30 covers unlit diodes 42 which comprise diode field 41. Center installation of invention 10 is further comprised of yellow lens 31. Yellow lens 31 covers diode field 41. Diode field 41 is comprised of unlit diodes 42. The lower installation of invention 10 is further comprised of green lens 32. Green lens 32 covers diode field 41. Diode field 41 is comprised of unlit diodes 42 and lighted diodes 39. Unlit diodes 42 substantially surround lighted diodes 39. Lighted diodes 39 form a directional arrow 40 within diode field 41. Directional arrow 40 is selectively pointed upward in this example of invention 10 application. Directional arrow 40 thereby signals traffic (not shown) for straight passage by traffic signal 12.

Figure 5:
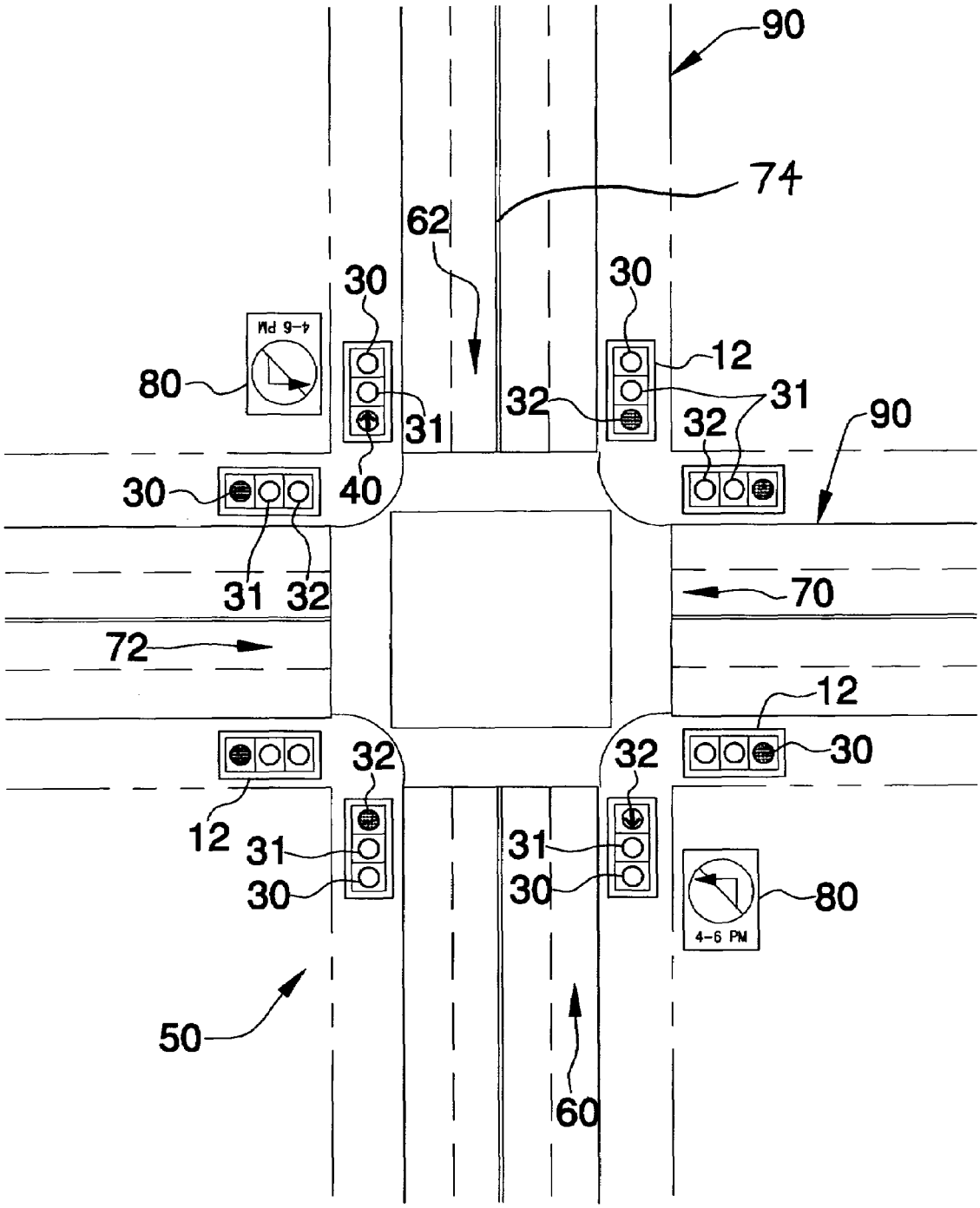
FIG. 5 is a view of the invention operationally installed in traffic signals at an intersection, the center lanes of northbound and southbound signaled for straight ahead flow only.

Referring to FIG. 5, the invention is installed within traffic signals 12 throughout intersection 50. For explanation purposes, signals 12 are on opposite sides of the street 90. In practical application, signals 12 are also positioned above approaching traffic in side-by-side lanes. Two traffic signals 12 are displayed to each direction of traffic. Directions of traffic are comprised of northbound 60 and southbound 62. Eastbound 72 and westbound 70 are at right angle intersection with both northbound 60 and southbound 62.

From the lower perspective of the intersection 50, northbound 60 views both signals immediately across the intersection 50 facing northbound 60. The left signal facing northbound 60 is visibly comprised of red lens 30 in the uppermost position. Red lens 30 covers unlit diodes 42 within. Red lens 30 is therefore unlit. The center lens is yellow lens 31. Yellow lens 31 is unlit. The lower lens covers lighted diodes 39 in the shape of directional arrow 40. Directional arrow 40 thereby signals northbound 60 that straight ahead only driving is permissible in the left northbound 60 lane. The traffic signal to the right of and facing northbound 60 is comprised of the top red lens 30. Red lens 30 is unlit. The center yellow lens 31 is also unlit. The lower green lens 32 is comprised of fully lighted diodes 39, thereby signaling that straight ahead passage for northbound 60 and right turn passage for northbound 60 are both permissible. Typical existing signage 80 further reinforces the signaled directional prohibitions at 4-6 PM.

Conversely, southbound 62 is faced with the same flow pattern but is a full 180 degrees opposed. Therefore, viewing from the perspective of southbound 62, the left lane next to center divider 74 is permitted to travel straight through only. This is indicated by directional arrow 40. This signal is via traffic signal 12 across intersection 50 and on the left corner when viewed from the perspective of southbound 62. Southbound 62 therefore sees another traffic signal 12 immediately ahead and on the right corner across intersection 50. Signal 12 displays unlit red lens 30. Yellow lens 31 is also unlit. Green lens 32 is fully lighted. Right turn and straight ahead passage is therefore permissible.

Intersecting traffic of westbound 70 and eastbound 72 are signaled for stop only. Westbound 70 views signals 12 across intersection 50. Signals 12 are each comprised of fully lighted red lenses 30. Red lenses 30 thereby signal stop. Yellow lenses 31 and green lenses 32 are unlit. Concurrently, eastbound 72 views traffic signals on the opposite side of intersection 50. Signals 12 display fully lighted red lenses 30. Yellow lenses 31 are unlit. Green lenses 32 are unlit. Signals 12 thereby signal westbound for full stop.

Installation of invention 10 into traffic signals 12 currently in use requires removal of typical existing lights (not shown) within each chosen typical single light housing 13. New light housings without lights installed are also fitted with the invention 10. Light housings 13 are typically stacked one atop the other in current usage. Light housings which are made as a unit are also fitted with the invention 10. Appropriate wires (not shown) are disconnected and replaced with wires 22 of the invention 10. The lens 29 of invention 10 is positioned through the exterior panel 26 of a currently existing single light housing 13. Attachment ears 24 are used to secure the flange 23 of invention 10 to the exterior panel, 26. Wires 22 are engaged with the existing terminal 37. A red lens 30, yellow lens 31, or green lens 32 is appropriately chosen to fit each particular traffic signal single light housing 13. Exterior panel 26 is then refitted to the single light housing 13. A typical traffic controller (not shown) thereby powers the appropriate contacts of wire terminal 37 to light the appropriate light emitting diodes 33 within the invention 10, thereby properly signaling traffic.

With respect to the above description then, it is to be realized that the optimum dimensional relationships for the parts of the bimodal traffic replacement light, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A bimodal replacement traffic light for fitting into a typically existing single light housing of a traffic signal, the replacement light comprising:

a round lens case fitting into the existing single light housing, the lens case having a back and a front;

a case flange about an outer perimeter of the lens case, the flange providing for attachment of the lens case within the light housing;

a field of light emitting diodes within the front of the lens case, the light emitting diodes positioned to project light from the front of the case;

a lens disposed on the front of the lens case;

means for selectively activating a plurality of diodes within the field of light emitting diodes, whereby the activated light emitting diodes form a traffic regulating indicator means.

2. The replacement traffic light in claim 1 wherein the indicator means further comprises a solid field of lighted light emitting diodes.

3. The replacement traffic light in claim 1 wherein the indicator means further comprises an arrow.

4. The replacement traffic light in claim 1 wherein the lens is selected from a group of colored lenses, the group of colored lenses consisting of the colors clear, red, yellow, and green.

5. The replacement traffic light in claim 2 wherein the lens is selected from a group of colored lenses, the group of colored lenses consisting of the colors clear, red, yellow, and green.

6. The replacement traffic light in claim 3 wherein the lens is selected from a group of colored lenses, the group of colored lenses consisting of the colors clear, red, yellow, and green.

7. The replacement traffic light in claim 4 wherein the light emitting diodes are selected from a group of colored light emitting diodes, the group of colored light emitting diodes consisting of the colors clear, red, yellow, and green.

8. The replacement traffic light in claim 5 wherein the lens is selected from a group of colored lenses, the group of colored lenses consisting of the colors clear, red, yellow, and green.

9. The replacement traffic light in claim 6 wherein the lens is selected from a group of colored lenses, the group of colored lenses consisting of the colors clear, red, yellow, and green.

10. A bimodal replacement traffic light for fitting into a typically existing single light housing of a traffic signal, the replacement light comprising:

a round lens case fitting into the existing single light housing, the lens case having a back and a front;

a lens disposed on the front of the lens case, the lens selected from a group of colored lenses, the group of colored lenses consisting of the colors clear, red, yellow, and green;

a case flange about an outer perimeter of the lens case, the flange providing for attachment of the bimodal light within the light housing;

a field of light emitting diodes within the front of the lens case, the light emitting diodes positioned to project light from the front of the case, the light emitting diodes selected from a group of colored light emitting diodes, the group of colored light emitting diodes consisting of the colors clear, red, yellow, and green;

a first set of wires connected to a first set of the light emitting diodes, the first set of light emitting diodes forming the shape of an arrow;

a second set of wires connected to a second set of light emitting diodes, the second set of light emitting diodes comprising all of the light emitting diodes in the field;

a common circuit connecting all of the light emitting diodes;

a lead common wire connected to the common circuit a first lead wire connected to the first set of wires;

a second lead wire connected to the second set of wires;

a wire outlet in the back of the lens case, whereby the common wire, the first lead wire, and the second lead wire exit the lens case, the wires connecting to a wire terminal of the traffic signal, whereby the common wire, the first lead wire, and the second lead wire are selectively powered by a controller of the traffic signal.

11. The replacement traffic light in claim 10 wherein the arrow is a left arrow.

12. The replacement traffic light in claim 10 wherein the arrow is a right arrow.

13. The replacement traffic light in claim 10 wherein the arrow is a straight arrow.

14. A bimodal replacement traffic light for fitting into a typically existing single light housing of a traffic signal, the replacement light comprising:

a round lens case fitting into the existing single light housing, the lens case having a back and a front;

a case flange about an outer perimeter of the lens case, the flange providing for attachment of the bimodal light within the light housing;

a lens disposed on the front of the lens case;

a field of light emitting diodes within the front of the lens case, the light emitting diodes positioned to project light from the front of the case;

a first circuit connected to a first set of the light emitting diodes, the first set of light emitting diodes forming the shape of a left arrow;

a first lead wire connected to the first circuit;

a second circuit connected to a second set of light emitting diodes, the second set of light emitting diodes comprising the shape of a right arrow;

a second lead wire connected to the second circuit;

a third circuit connected to a third set of light emitting diodes, the third set of light emitting diodes comprising the shape of a straight arrow;

a third lead wire connected to the third circuit;

a fourth circuit connected to a fourth set of light emitting diodes, the fourth set of light emitting diodes comprising all of the light emitting diodes in the field;

a fourth lead wire connected to the fourth circuit;

a common circuit connecting all of the light emitting diodes;

a lead common wire connected to the common circuit;

a wire outlet in the back of the lens case, whereby the common wire, the first lead wire, the second lead wire, the third lead wire, and the fourth lead wire exit the lens case, the wires connecting to a wire terminal of the traffic signal, whereby the common wire, the first lead wire, the second lead wire, the third lead wire, and the fourth lead wire are selectively powered by a controller of the traffic signal.

15. The replacement traffic light in claim 14 wherein the lens is selected from a group of colored lenses, the group of colored lenses consisting of the colors clear, red, yellow, and green.

16. The replacement traffic light in claim 15 wherein the light emitting diodes are selected from a group of colored light emitting diodes, the group of colored light emitting diodes consisting of the colors clear, red, yellow, and green.

17. The replacement traffic light in claim 15 wherein the lens is removable.

18. The replacement traffic light in claim 16 wherein the lens is removable.

* * * * *